United States Patent [19]

Kasuga et al.

[11] 4,188,504

[45] Feb. 12, 1980

[54] SIGNAL PROCESSING CIRCUIT FOR BINAURAL SIGNALS

[75] Inventors: Masao Kasuga, Sagamihara; Nobuaki Takahashi, Yamato; Masaaki Sato, Yokohama; Kohji Seki, Ichikawa; Toshinori Mori, Fujisawa; Makoto Iwahara, Sagamihara, all of Japan

[73] Assignee: Victor Company of Japan, Limited, Yokohama, Japan

[21] Appl. No.: 899,892

[22] Filed: Apr. 25, 1978

[30] Foreign Application Priority Data

| | | | |
|---|---|---|---|
| Apr. 25, 1977 | [JP] | Japan | 52-47585 |
| Apr. 25, 1977 | [JP] | Japan | 52-47586 |
| Apr. 25, 1977 | [JP] | Japan | 52-47587 |
| Apr. 25, 1977 | [JP] | Japan | 52-47588 |
| May 6, 1977 | [JP] | Japan | 52-51862 |
| May 6, 1977 | [JP] | Japan | 52-51863 |

[51] Int. Cl.[2] ..... H04R 5/04

[52] U.S. Cl. ..... 179/1 GP; 179/1 G

[58] Field of Search ..... 179/1 G, 1 GP, 1 GQ, 179/1 D, 1 J, 100.4 ST, 100.1 TD, 1 VL; 84/DIG. 27

[56] References Cited

U.S. PATENT DOCUMENTS

| | | | |
|---|---|---|---|
| Re. 29,490 | 12/1977 | Shamma | 179/1 GP |
| 2,920,138 | 1/1960 | Fogel | 179/1 G |
| 3,881,057 | 4/1975 | Adachi et al. | 179/1 J |
| 3,920,903 | 11/1975 | Beller | 179/1 D |
| 4,087,631 | 5/1978 | Yamada et al. | 179/1 G |
| 4,118,569 | 10/1978 | Iwahara et al. | 179/1 GP |
| 4,118,601 | 10/1978 | Yeap | 179/1 D |

FOREIGN PATENT DOCUMENTS

| | | | |
|---|---|---|---|
| 2736558 | 2/1978 | Fed. Rep. of Germany | 179/1 G |

OTHER PUBLICATIONS

"Stereophonic Reproduction" in *Audio Engineering* by Lode, Jan. 1950, pp. 15, 46 and 47.

*Primary Examiner*—Douglas W. Olms
*Attorney, Agent, or Firm*—Haseltine, Lake & Waters

[57] ABSTRACT

A binaural signal processing circuit comprising a first system for imparting an input signal with a transfer characteristic equal to the transfer characteristic hL(t; $\theta$, r) from a sound source to the left ear of a listener, where $\theta$ represents an angle between the front direction of the listener and the sound source, and r represents a distance between the sound source and the listener, a second system for imparting the input signal with a transfer characteristic equal to the transfer characteristic hR(t; $\theta$, r) from the sound source to the right ear of the listener, a system for variably controlling the transfer functions of the first and second transfer function imparting systems, and a further system for deriving binaural signals from the first and second transfer function imparting systems.

6 Claims, 21 Drawing Figures

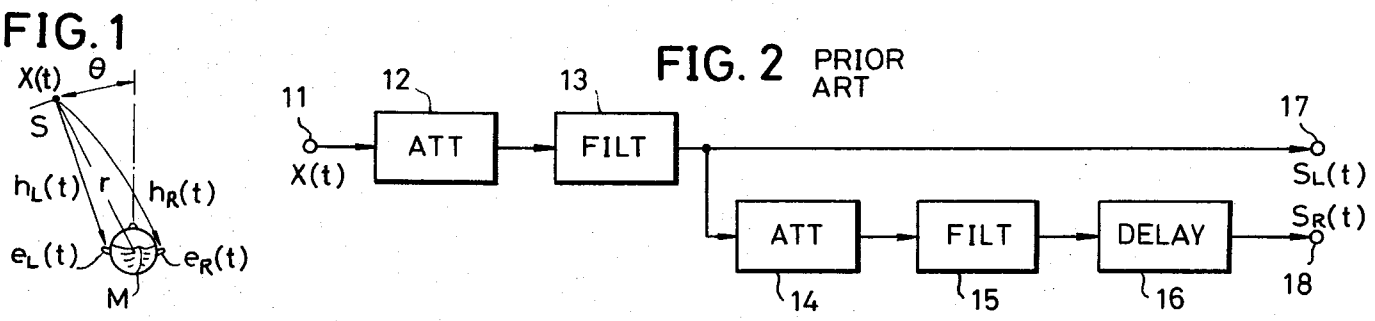
FIG. 1
X(t)
S
θ
r
$h_L(t)$
$h_R(t)$
$e_L(t)$
$e_R(t)$
M
FIG. 2 PRIOR ART
11
X(t)
12
ATT
13
FILT
ATT
14
FILT
15
DELAY
16
17
$S_L(t)$
$S_R(t)$
18
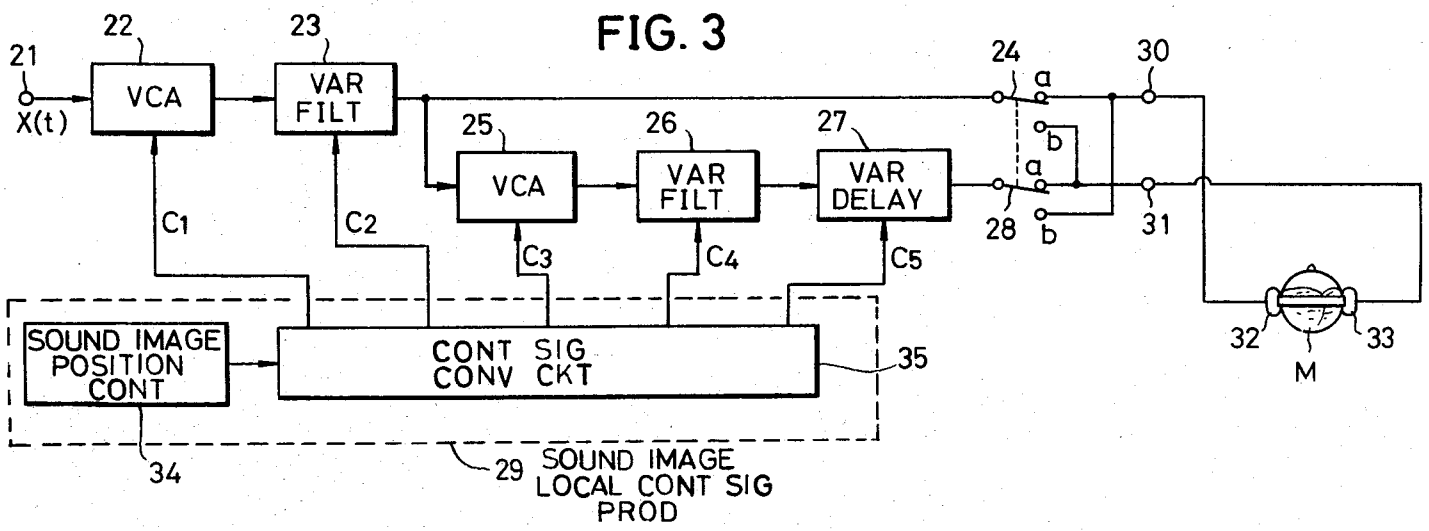
FIG. 3
21
X(t)
22
VCA
23
VAR FILT
25
VCA
26
VAR FILT
27
VAR DELAY
24
28
30
31
32
33
M
C1
C2
C3
C4
C5
CONT SIG CONV CKT
35
SOUND IMAGE POSITION CONT
34
29
SOUND IMAGE LOCAL CONT SIG PROD SIG PROCESS CKT
VCA
VAR FILT
VCA
VAR FILT
VAR DELAY
SOUND IMAGE LOCAL CONT SIG PROD
MIX
MIX
SIG PROCESS CKT
SIG PROCESS CKT
SIG CONV
SIG CONV
SIG CONV
SW
VAR ATT
VAR FILT
VAR ATT
VAR FILT
SOUND IMAGE LOCAL CONT SIG PROD
MIX
MIX
X(t)
Sxl(t)
Sxr(t)
Sxl(t:θ.r)
Sxr(t:θ.r)
SIG CONV

SIGNAL PROCESSING CIRCUIT FOR BINAURAL SIGNALS

BACKGROUND OF THE INVENTION

The present invention relates generally to signal processing circuits for binaural signals, and more particularly to a circuit capable of processing signals in such a manner that a signal having no localization information is converted to obtain binaural signals, and further, that a localization position of the sound image is shifted arbitrarily.

A so-called binaural system in which microphones are provided at the positions of the two ears of a dummy head having the shape of a human head to record the sounds respectively at the positions of the two ears, and the sounds obtained by reproducing these recorded sounds are respectively supplied to the headphone speakers for respective ears of a headphone set is known. By using this system, the listener can hear these sounds as though the position of the acoustic image were at the same position as that of the actual sound source.

In order to obtain this binaural signal, a dummy head must be used, heretofore. Accordingly, a signal processing circuit for obtaining signals substantially equivalent, electrically, to binaural signals from ordinary monaural signals or respective channel signals of stereo signals was devised. By the use of this signal processing circuit, substantially binaural signals can be obtained without the use of a dummy head.

However, the signal processing circuit of this type known heretofore is not able to shift the localization position of the sound image to a position where a listener intends to localize. In a system using the dummy head, for shifting the sound image, the sound source is required to move with respect to the dummy head, or the dummy head is required to move with respect to the sound source, whereby this moving operation is rather troublesome.

SUMMARY OF THE INVENTION

Accordingly, it is a general object of the present invention to provide a novel and useful binaural signal processing circuit.

A specific object of the invention is to provide a binaural signal processing circuit which is capable of processing a signal so that a localization position of the sound image is caused to move in an arbitrary manner.

Another object of the invention is to provide a binaural signal processing circuit so constructed that distance information and directional information between a specific localization position and a listener in a space area in which a sound image is to be localized are derived from a signal having no localization information by different circuits.

Other objects and further features of the present invention will be apparent from the following detailed description set forth in conjunction with the accompanying drawings.

BRIEF DESCRIPTION OF THE DRAWINGS

In the drawings:

FIG. 1 is a diagramatic plan view illustrating a position relationship between a single sound source and a listener;

FIG. 2 is a block schematic diagram of one example of a binaural signal processing circuit known in the art, FIG. 3 is a block schematic diagram showing a first embodiment of a binaural signal processing circuit according to the present invention;

DETAILED DESCRIPTION

Figure 4:
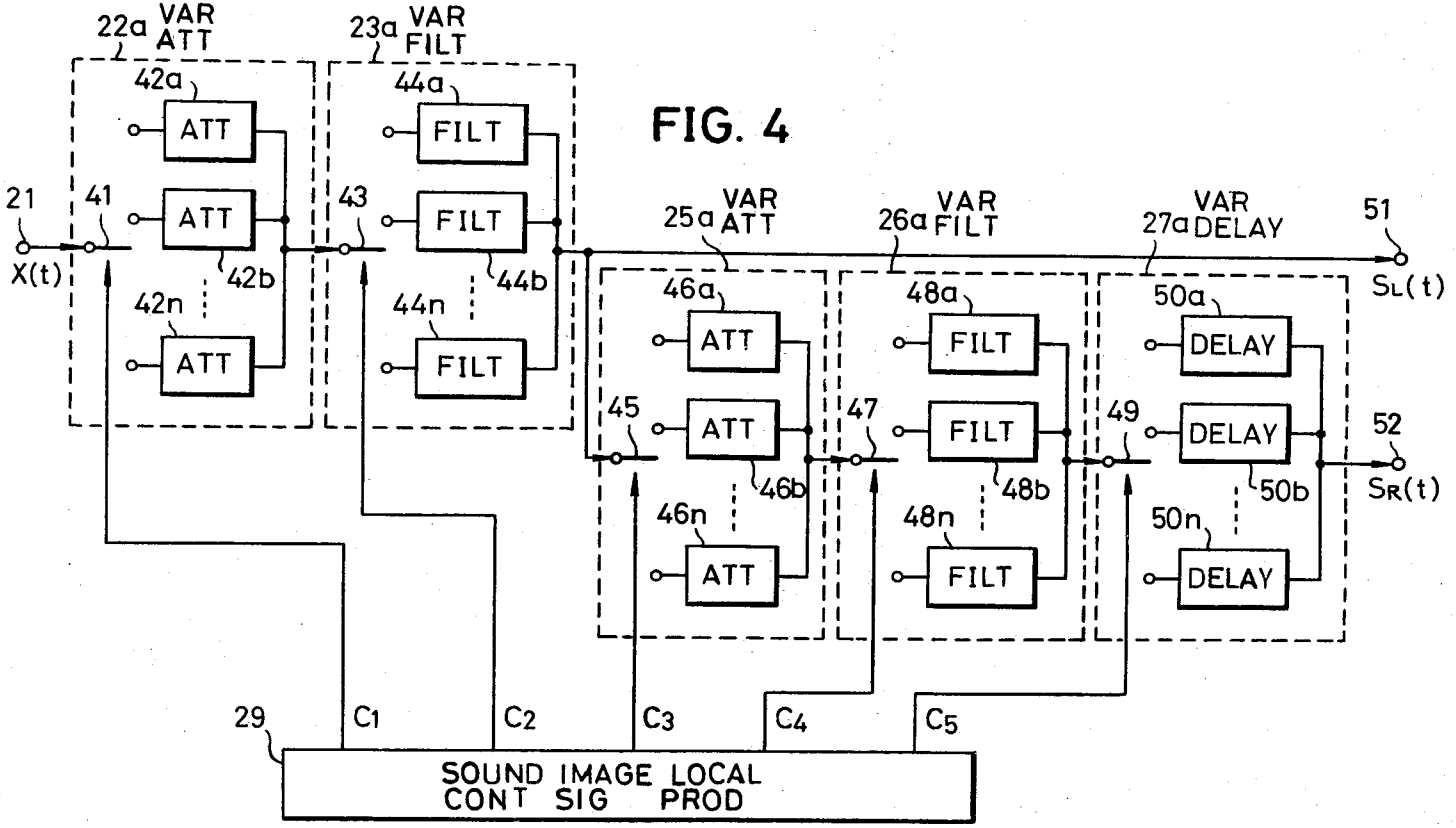
FIG. 4 is a block schematic diagram showing a second embodiment of a binaural signal processing circuit according of the present invention.

For facilitating understanding of the principle of a signal processing circuit, the relationship between a sound source and a listener will first be described.

It will be assumed that, as illustrated in FIG. 1, a listener M is listening to a sound emitted in a space from a sound source S which is at a position offset by an angle $\theta$ from the front direction of the listener M, and spaced by the distance r from the listener M.

Now, assuming that a transfer characteristic from the sound source S to the left ear of the listener M is denoted by $hL(t; \theta, r)$, another transfer characteristic from the sound source S to the right ear of the listener M by $hR(t; \theta, r)$, and a sound source signal by $x(t)$. Then, the signals $eL(t)$ and $eR(t)$ at the entrances of the left and right ears of the listener M are expressed by the following equation, using a mathematical technique of convolution integration.

$$\begin{bmatrix} eL(t) \\ eR(t) \end{bmatrix} = x(t) * \begin{bmatrix} hL\ (t;\ \theta,\ r) \\ \mathrm{hR}\ (t;\ \theta,\ r) \end{bmatrix} \quad (1)$$

When the output signals of the signal processing circuit are denoted by SL(t) and SR(t), the output signals SL(t) and SR(t) are required to be one, as expressed as follows.

$$\begin{bmatrix} SL(t) \\ SR(t) \end{bmatrix} = \begin{bmatrix} \mathrm{eL}(t) \\ eR(t) \end{bmatrix} \quad (2)$$

When this Eq.(2) is substituted in Eq.(1), the following equation is obtained.

$$\begin{bmatrix} SL(t) \\ SR(t) \end{bmatrix} = x(t) * \begin{bmatrix} hL\ (t;\ \theta,\ r) \\ \mathrm{hR}\ (t;\ \theta,\ r) \end{bmatrix} \quad (3)$$

This Eq.(3) is further rewritten as follows.

$$\begin{bmatrix} SL(t) \\ SR(t) \end{bmatrix} = x(t) * hL(t;\ \theta,\ r) * \begin{bmatrix} 1 \\ hR(t;\ \theta,\ r)/hL(t;\ \theta,\ r) \end{bmatrix} \quad (4)$$

where, (hR (t; $\theta$, r)/hL (t; $\theta$, r)) denotes a characteristic of the difference between two ears, which may be expressed by acoustic pressure difference or time difference.

As the signal processing circuit for obtaining the binaural signals SL(t) and SR(t) expressed by the Eq.(4), a circuit illustrated in FIG. 2 has been known heretofore.

A single sound-source signal x(t) having no localization information introduced through an input terminal 11 is applied to an attenuator 12 for imparting attenuation of magnitude according to the distance r, and is then supplied to a filter 13 for imparting a predetermined frequency characteristic. The output signal of the filter 13 is led out from an output terminal 17, as the binaural signal SL(t) having the characteristic of hL (t; $\theta$, r).

On the other hand, the output signal of the filter 13 passes through an attenuator 14, a filter 15, and a delay circuit 16 for imparting a predetermined delay time, in succession, thereby assuming a characteristic of (hR(t; $\theta$, r)/hL(t; $\theta$, r). The resulting signal is led out from an output terminal 18 as a binaural signal SR(t).

Here, since the sound image is located at a position determined by a distance r and an angle $\theta$ in FIG. 1, the binaural signal eR(t) received by the right ear is required to be much delayed in the delay circuit 16, in comparison with the other binaural signal eL(t) received by the left ear. While, in the case where the sound image is located near the right ear of the listener M, a binaural signal eL(t)' to be received by the left ear is required to be much delayed in compared with a binaural signal eR(t)' to be received by the right ear. Accordingly, the binaural signal eL(t)' is sent out from the output terminal 18, and the other binaural signal eR(t)' is sent out from the output terminal 17.

When the listener hears the above described binaural signals SL(t) and SR(t) by his left and right ears respectively, through the use of a headphone, he hears the signal as though the sound image is localized at the position determined by the angle $\theta$ and the distance r as illustrated in FIG. 1.

Therefore, the known signal processing circuit has no capability of the shifting the position of sound image localization to a desired position, as described hereinbefore.

The present invention seeks to eliminate the aforementioned difficulties, and several embodiments of the present invention will now be described hereinafter.

Referring to FIG. 3, a signal without any localization information introduced through an input terminal 21 is caused to pass through, in succession, a voltage-controlled attenuator (VCA) 22 as a variable attenuation circuit, and a variable filter 23 such as a voltage-controlled filter, whereby the signal is imparted with the characteristic hL(t; $\theta$, r). The signal led out from the variable filter 23 is supplied, on one hand, to a switch 24 as a binaural signal SL(t). On the other hand, the output signal of the variable filter 23 is supplied to a voltage-controlled attenuator 25, where it is subjected to attenuation appropriately, and is then caused to pass through a variable filter 26 and a variable delay circuit 27, in succession, whereby the signal is imparted with the characteristic hR (t; $\theta$, r). The variable delay circuit 27 is organized by a delay circuit comprising semi-conductor elements such as BBD (bucket brigade device) or CCD (chargecoupled device), in which the delay time undergoes change in accordance with clock frequency. The output signal of this variable delay circuit 27 is supplied as a binaural signal SR(t) to a switch 28.

The switches 24 and 28 undergo changing over operation between two contact points a and b, in response to a quadrant detection output signal from a device 29 for producing sound image localization control signal described hereinafter. For instance, in the case where the sound image is to be oriented at a position offset leftwards from the front direction of the listener, the switches 24 and 28 are respectively connected to their contact points a. Accordingly, the signals SL(t) and SR(t) are respectively led out from terminals 30 and 31, and are then supplied to speakers 32 and 33 of a headphone receiver which are attached to two ears of the listener M. Alternately, in the case where the sound image is to be localized at a position offset rightwards from the front direction of the listener, the switches 24 and 28 are changed over to contact points b, responsive to the quadrant detection output signal. Thus, the signal supplied to the switches 24 and 28 are respectively supplied to the speakers 33 and 32.

The sound image localization control signal producing circuit 29 comprises a sound image position control device 34 and a control signal conversion circuit 35, which are described hereinafter.

An information signal of sound image position led out from the sound image position control device 34 is supplied to the control signal conversion circuit 35, where it is converted to control signals C1 through C5 having level or frequency depending on the sound image position information. In the present embodiment, the control signals C1 through C4 are of DC voltage, and are adapted to change variably the attenuation magnitude of the voltage-controlled attenuators 22 and 25, and the frequency characteristics of the variable filters 23 and 26. The control signal C5 is an oscillation frequency signal led out from a voltage controlled oscillator, which is supplied as a clock signal to the variable delay circuit 27 for variably controlling the delay time thereof.

Thus, the transfer characteristics hL (t; θ, r) and hR (t; θ, r) undergo change due to control signals C1 through C5. As a consequence, the binaural signals for shifting continuously position of sound image localization to a desired position in a sound field space are supplied to the speakers 32 and 33.

Next, a second embodiment of a circuit of the present invention is illustrated in FIG. 4, in which parts which are the same as corresponding parts in FIG. 3 are designated by like reference numerals. Detailed description of such parts will not be repeated. A variable attenuation circuit 22*a* comprises an analog switch 41 and a plurality of attenuators 42*a*, 42*b*, . . . , 42*n* respectively having different attenuation magnitude. The analog switch 41 is adapted to be changed over in response to the control signal C1, and an input signal x(t) is thereby supplied to one selected attenuator out of the attenuators 42*a* through 42*n*. This results in that the attenuation magnitude of the variable attenuation circuit 22*a* is changed over. Similarly, a variable filter circuit 23*a* comprises an analog switch 43 adapted to be changed over in response to the control signal C2, and a plurality of filters 44*a*, 44*b*, . . . , 44*n* which respectively have different filtering characteristics and are selectively connected by this analog switch 43. A variable attenuation circuit 25*a* comprises an analog switch 45 adapted to be changed over in response to the control signal C3, and attenuators 46*a* through 46*n* which respectively have different attenuation magnitude and are selectively connected by the analog switch 45. A variable filter circuit 26*a* comprises an analog switch 47 adapted to be changed over in response to the control signal C4, and a plurality of filters 48*a* through 48*n* which respectively have different filtering characteristics and are selectively connected by the analog switch 47. A variable delay circuit 27*a* includes an analog switch 49 adapted to be changed over in response to the control signal C5, and delay circuits 50*a* through 50*n*, the delay time thereof being different respectively, which are selectively connected by means of the analog switch 49.

The output signals of the variable filter circuit 23*a* and the variable delay circuit 27*a* are respectively supplied by way of output terminals 51 and 52 to the switches 24 and 28. The analog switches 41, 43, 45, 47, and 49 are caused to be operated by binary codes. The control signals C1 through C5 are signals expressed by binary codes.

Moreover, in replace of these analog switches, rotary switches may be used, which are adapted to be changed over through manipulation. In this modification, the sound image position control signal generating device 29 may be omitted.

Figures 5, 6:
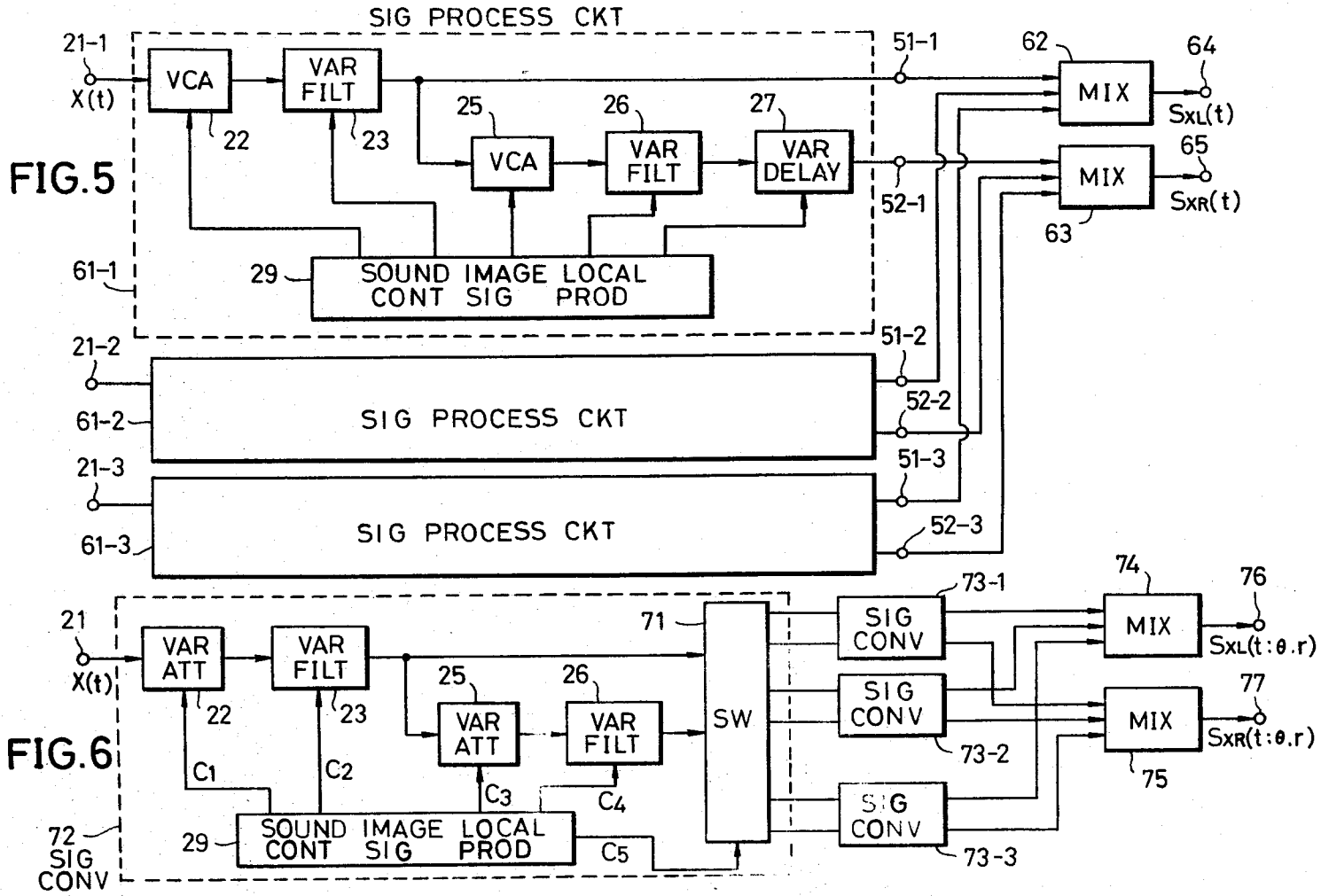
FIG. 5 is a block schematic diagram showing a third embodiment of a binaural signal processing circuit according to the present invention.
FIG. 6 is a block schematic diagram showing a fourth embodiment of a binaural signal processing circuit of the present invention.

An embodiment in which the present invention is applied to a multichannel signal system is indicated in FIG. 5. To signal processing circuits 61-1, 61-2, and 61-3 (illustrations of block schematic diagrams inside of the circuits 61-2 and 61-3 being omitted) which have organizations similar to the circuit organizations preceding to the switches 24 and 28 in FIG. 3, are respectively supplied first through third channel signals which have introduced through the input terminals 21-1, 21-2, and 21-3. Signals led out from the output terminals 51-1 through 51-3 of the circuits 61-1 through 61-3 are mixed in a mixer 62, and thereafter, led out from an output terminal 64. The other signals led out from the output terminals 52-1 through 52-3 are mixed in a mixer 63, and thereafter, led out from an output terminal 65. These output signals led out from the output terminals 64 and 65 are respectively supplied to the aforementioned switches 24 and 28. Further, the number of channel signal systems is not limited to three.

When the listener M hears the binaural signals SxL(t) and SxR(t) obtained through mixing in the mixers 62 and 63 by use of headphone speakers, he hears them as though three sound images, as a hearing sensation, are localized at positions or shifted within a sound field.

Next, assuming the output signals of the signal processing circuit to be SL(t; θ, r) and SR(t; θ, r), and further introducing into the above Eq.(3) a concept of standardization of the distance r between the listener M and the sound source with a standard distance $r_O$. Then, the Eq.(3) can be rewritten as following equation.

$$\left.\begin{aligned} SL(t;\theta,r) &= x(t) * hL(t;\theta,r_0) * \frac{hL(t;\theta,r)}{hL(t;\theta,r_0)} \\ SR(t;\theta,r) &= x(t) * hR(t;\theta,r_0) * \frac{hR(t;\theta,r)}{hR(t;\theta,r_0)} \end{aligned}\right\} \quad (5)$$

When the Eq.(5) is further rewritten, in taking account of circuit organization, the Eq.(5) is represented as follows.

$$SL(t;\theta,r) = x(t) * \frac{hL(t;\theta,r)}{hL(t;\theta,r_0)} * hL(t;\theta,r_0) \quad (6\text{-}1)$$

$$SR(t;\theta,r) = x(t) * \frac{hL(t;\theta,r)}{hL(t;\theta,r_0)} * \frac{hR(t;\theta,r)/hL(t;\theta,r)}{hR(t;\theta,r_0)/hL(t;\theta,r_0)} * hR(t;\theta,r_0) \quad (6\text{-}2)$$

In the above Eqs. (6-1) and (6-2), the term $$\frac{hL(t;\theta,r)}{hL(t;\theta,r_0)}$$

is a changing amount of transfer characteristic from the sound source x(t) to the entrance of the listener's ear near the sound source due to the change of distance. Signals corresponding to this term can be obtained by the attenuator and filter. In the case where the distance r is larger than 2 meters, a so-called inverse square characteristic is held wherein the level attenuates in inverse proportion to square of distance. For this reason, the circuit for obtaining the above signal can be organized only with the attenuator.

Another term $$\left(\frac{hR(t;\theta,r)/hL(t;\theta,r)}{hR(t;\theta,r_0)/hL(t;\theta,r_0)}\right)$$

of the Eq. (6–2) is a changing amount of the so-called characteristics of the difference between the two ears due to the change in distance, and may be represented by acoustic pressure difference and time difference. The time difference, however, generally changes little, whereby the signal of transfer characteristic corresponding to this term can be obtained by the attenuator and the filter. Here, when the distance r is larger than 2 meters, the transfer characteristic represented by this term becomes unity, whereby this term may be then neglected.

Next, an embodiment of the signal processing circuit capable of imparting the above described transfer characteristic will be described in conjunction with FIG. 6. Parts shown in FIG. 6 which are the same as corresponding parts shown in FIG. 3 are designated by like reference numerals, and detailed description of such parts will not be repeated.

A signal which is led out by way of the variable attenuation circuit 22 and the variable filter circuit 23 and to which the characteristics $$\left(\frac{hL(t;\theta,r)}{hL(t;\theta,r_0)}\right)$$

have been imparted is supplied to a switcher 71. On the other hand, the signal which is led out further by way of the variable attenuation circuit 25 and the variable filter circuit 26 and to which the characteristic $$\left(\frac{hR(t;\theta,r)/hL(t;\theta,r)}{hR(t;\theta,r_0)/hL(t;\theta,r_0)}\right)$$

has been imparted is supplied to the switcher 71.

The circuits of the above structural organization constitutes a first signal conversion circuit 72 which is adapted to impart the distance information of the sound image localization position to the input signal.

The switcher 71 is adapted to change over, in response to the control signal C5, the signal which is supplied from the variable filter circuits 23 and 26, and then to lead the output signal to one circuit which imparts a required localization direction information, among second signal conversion circuits 73-1 through 73-3 which are respectively adapted to impart a predetermined localization direction information. Here, the transfer characteristic in which a distance r between the sound image localization position and the listener is caused to be changed variably in accordance with the control signal from the sound image localization control signal producing device 29 has been imparted to the aforementioned signal supplied from the variable filter circuits 23 and 26.

Among the output signals of the second signal conversion circuits 73-1 through 73-3, the binaural signals to be transferred to the left ear of the listener are supplied to the mixer 74 thereby to be mixed, and, the binaural signals to be transferred to the right ear of the listener are supplied to the mixer 75 thereby to be mixed. The output signals of the mixers 74 and 75 are resultingly led out from output terminals 76 and 77, as binaural signals SXL(t; $\theta$, r), and SXR(t; $\theta$, r) to be heard by left and right ears of the listener.

Moreover, in the case where the circuit of the present embodiment is applied to the multi-channel signal system, the signal processing circuit may be of structural organization wherein the number of first signal conversion circuit 72 corresponding to the number of channels are provided, and the output signals from respective first signal conversion circuits are supplied to only one set of the second signal conversion circuits 73-1 through 73-3. In this case, the number of couples of the second signal conversion circuit may be unity, and is not required to be the number corresponding to the number of channels. Moreover, the number of second signal conversion circuits 73-1 through 73-3 is not limited to three, but the second signal conversion circuits are provided in the directions for localizing the sound image, in accordance with necessity.

Figure 7:
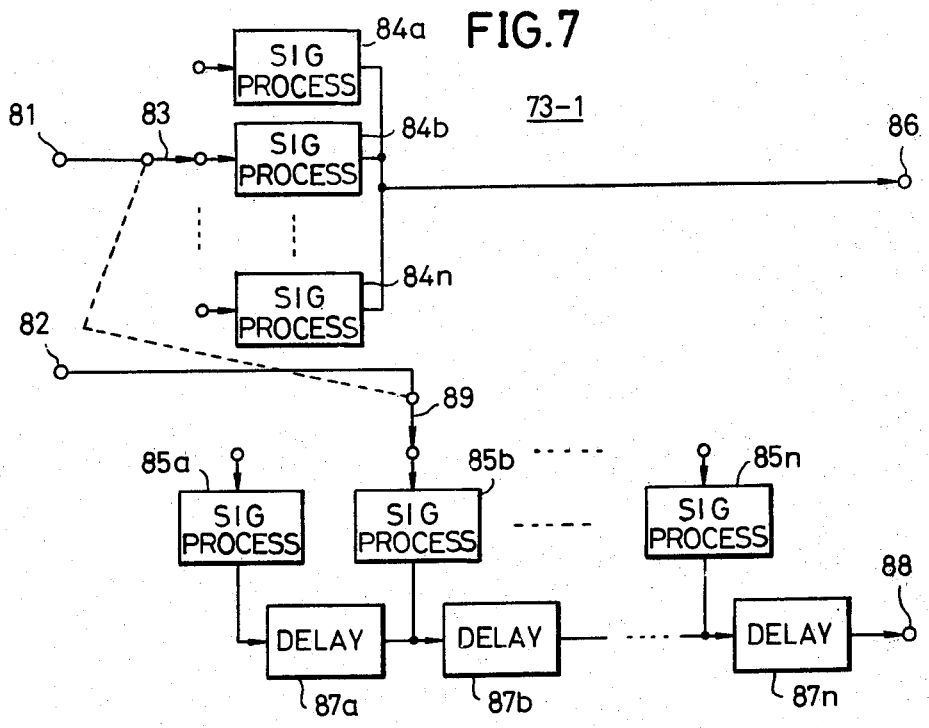
FIG. 7 is a block schematic diagram showing, in detail, a portion of the block system indicated in FIG. 6.

One embodiment of the aforementioned signal conversion circuit 73-1 (73-2, 73-3) is indicated in FIG. 7. The signals led out from the switcher 71 respectively pass through an input terminal 81 and a switch 83, and an input terminal 82 and a switch 89, and are then respectively supplied to a single processing circuit respectively selected among signal processing circuits **84*a* through 84*n*, and 85*a* through 85*n* which respectively have predetermined different characteristics. The switches 83 and 84 are interlocked and changed over in response to a signal corresponding to a localization direction led out from the sound image localization control signal producing circuit 29. The signal processing circuits 84*a* through 84*n* are circuits for obtaining a characteristic hL(t; $\theta$, $r_O$), and the signal processing circuits 85*a* through 85*n*** are circuits for obtaining a characteristic hR(t; $\theta$, $r_O$).

The signal processing circuits **85*a* through 85*n* are respectively connected to the delay circuits 87*a* through 87*n***, which are connected in cascade. The above given term $$\frac{hR(t;\theta,r)}{hL(t;\theta,r)}$$

has a time difference, the value of which varies according to a localized direction $\theta$, and becomes maximum when $\theta=90°$. Accordingly, in this case, the output signal of the signal processing circuit **85*a* is caused to delay by the total time of delay times $\tau 1$ through $\tau n$ of the delay circuits 87*a* through 87*n*. Moreover, in the case of $\theta<90°$, the delay circuits 87*b* through 87*n*** are selectively used in common, whereby a predetermined delay time can be obtained by a simple and inexpensive circuit organization. In accordance with this delay time, the localized direction of sound image undergoes change.

Figure 8:
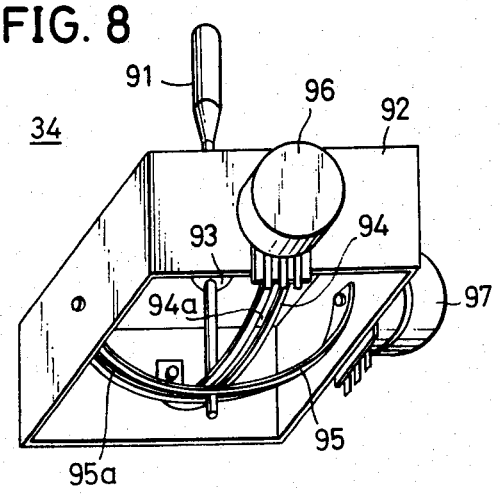
FIG. 8 is a perspective view showing one example of a sound image position control device, as viewed from the bottom thereof.
Figure 9:
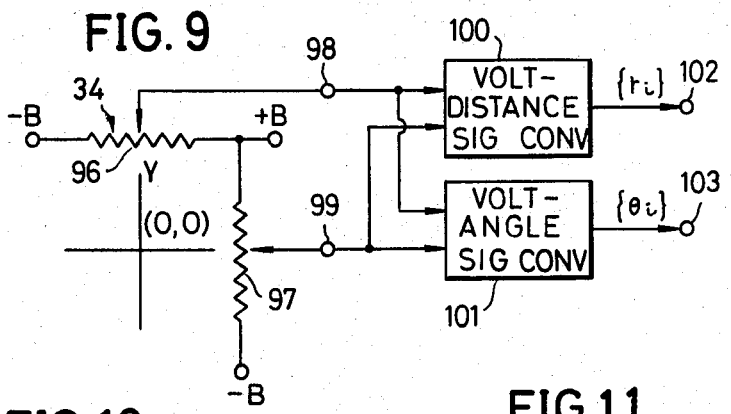
FIG. 9 is a block schematic diagram showing one embodiment, in portion, of a sound image localization control signal producing circuit.

Next to be described is a concrete embodiment of the sound image localization control signal producing circuit 29. The sound image position control device 34 is of oganization, for instance, indicated in FIG. 8. A casing 92 is provided with a manipulation stick 91 adapted to be rotatable about a support bearing 93 thereby inclining to a desired direction. The stick 91 is engaged at its lower end with a point of intersection of slits **94*a* and 95*b* respectively formed in arcuate rotary levers 94 and 95. These levers 94 and 95 are rotatably provided inside of the casing 92, with intersecting at right angle. The rotary levers 94 and 95 are respectively connected at their one end to rotary shafts of rotary variable resistors 96 and 97 mounted to the external side walls of the casing 92, and thereby rotating together with the rotary shaft. A positive reference voltage +B is applied to one end of the variable resistors 96 and 97, and a negative reference voltage −B is applied to the other end of the variable resistor 97 and 97 as shown in FIG. 9. As the stick 91 is rotated to incline to a predetermined direction, the lower end thereof undergo displacement on a semi-spherical surface. Interrelatedly with this displacement, the rotary levers 94 and 95 rotates, whereby the potentials at the sliders of the variable resistors 96 and 97** change variably.

The variable resistors 96 and 97 are represented as indicated in FIG. 9, in relation with a position of the stick 91 expressed by X axis (abscissa) and Y axis (ordinate) on the horizontal surface. In two-dimension rectangular coordinates, the origin (0, 0) means a position of the stick 91, being perpendicular to the horizontal plane, projected to the horizontal plane. The rotary variable resistors 96 and 97 are so arranged that, in this state, sliders are set at newtral positions of the variable resistors 96 and 97. Accordingly, when the stick 91 is in a state perpendicular to the horizontal plane, the value of the DC voltage led to output terminals 98 and 99 from the sliders of the rotary variable resistors 96 and 97 becomes OV respectively.

As the stick 91 is rotated, the signals having their levels and polarities in accordance with mapping positions in two-dimension rectangular coordinates X and Y are derived from the variable resistors 96 and 97. Based on this signal, the displacement of the stick 91 is detected in terms of mapping of the stick 91 onto the aforementioned two-dimension rectangular coordinates, that is, by a distance $r$ $(=\sqrt{x^2+y^2})$ from the origin and an angle $\theta$ $(=\tan^{-1}(x/y))$ offset from a predetermined reference direction.

Accordingly, the DC voltage led out from the output terminals 98 and 99 have level and polarity according to the motion of mapping of the stick 91 on X and Y coordinates, due to change in resistance values of the rotary variable resistors 96 and 97 caused by manipulation of the stick 91. The DC voltage thereby represents or defines a point of (x, y) in X-Y coordinates system.

These DC voltage signals are supplied to a voltage-distance signal conversion circuit 100 in the control signal conversion circuit 35, where they are converted to a signal representing $x^2$ and $y^2$, and then matrixed to a signal representing $x^2+y^2$. The resulting signal is led out from an output terminal 102 as an analog signal $\{r_i\}$ expressing square of r, that is, $r^2$.

On the other hand, the DC voltage signals led out from the output terminals 98 and 99 are supplied to a voltage-angle signal conversion circuit 101 in the control signal conversion circuit 35. The conversion circuit 101 is adapted to convert the input signal into a signal of representing x/y in a divider, and then, to convert the signal into a signal representing $\tan^{-1} x/y$. The above DC voltage signals are thereby converted, in the conversion circuit 101, into an analog signal $\{\theta_i\}$ representing an angle $\theta$ offset from a predetermined reference direction, and are then led to an output terminal 103.

Figure 10:
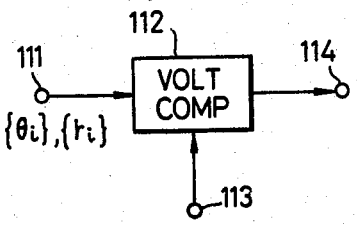
FIGS. 10 and 11 are block schematic diagram respectively showing circuits for obtaining control signal from output signal of the block system illustrated in FIG. 9.
Figure 11:
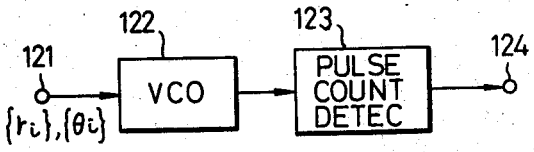

FIGS. 10 and 11 are block schematic diagrams showing each embodiments of circuit parts for discriminating distance or angle.

Referring to FIG. 10, the aforementioned analog signal $\{r_i\}$ or $\{\theta_i\}$ is supplied, through an input terminal 111, to a voltage comparator 112, where it is compared with a reference voltage which is set to a level corresponding to a certain distance and angle in X, Y coordinates system, and is supplied from an input terminal 113.

When the level of input signal $\{r_i\}$ or $\{\theta_i\}$ is larger or smaller than the reference voltage, it is led, as a signal of representing a distance r or an angle $\theta$, to an output terminal 114. Therefore, the voltage comparator 112 generally requires to provide two systems for discriminating distance and for discriminating angle. Moreover, for improving discriminating accuracy, a number of voltage comparators may be used.

Referring next to FIG. 11, the distance detection analog signal $\{r_i\}$ or the angle detection analog signal $\{\theta_i\}$ introduced through an input terminal 121 is applied, as a control signal, to a voltage controlled oscillator (VCO) 122. The VCO 122 is thereby controlled its oscillation frequency. The output signal of the VCO 122 is supplied to a well-known pulse count type detection circuit 123, where it is subjected to detection. The signal thus detected is led out from an output terminal 124, as a signal in which distance r or angle $\theta$ has been discriminated.

The present embodiment also requires to provide two systems for discriminating distance and for discriminating angle, similarly as in the case of embodiment indicated in FIG. 10. Moreover, a free running oscillation frequency of the VCO 122 is preset to a certain reference distance r or angle $\theta$ in X, Y coordinates system.

The signals led out from the output terminals 114 and 124 are used as the aforementioned control signals C1 through C5.

Figure 12:
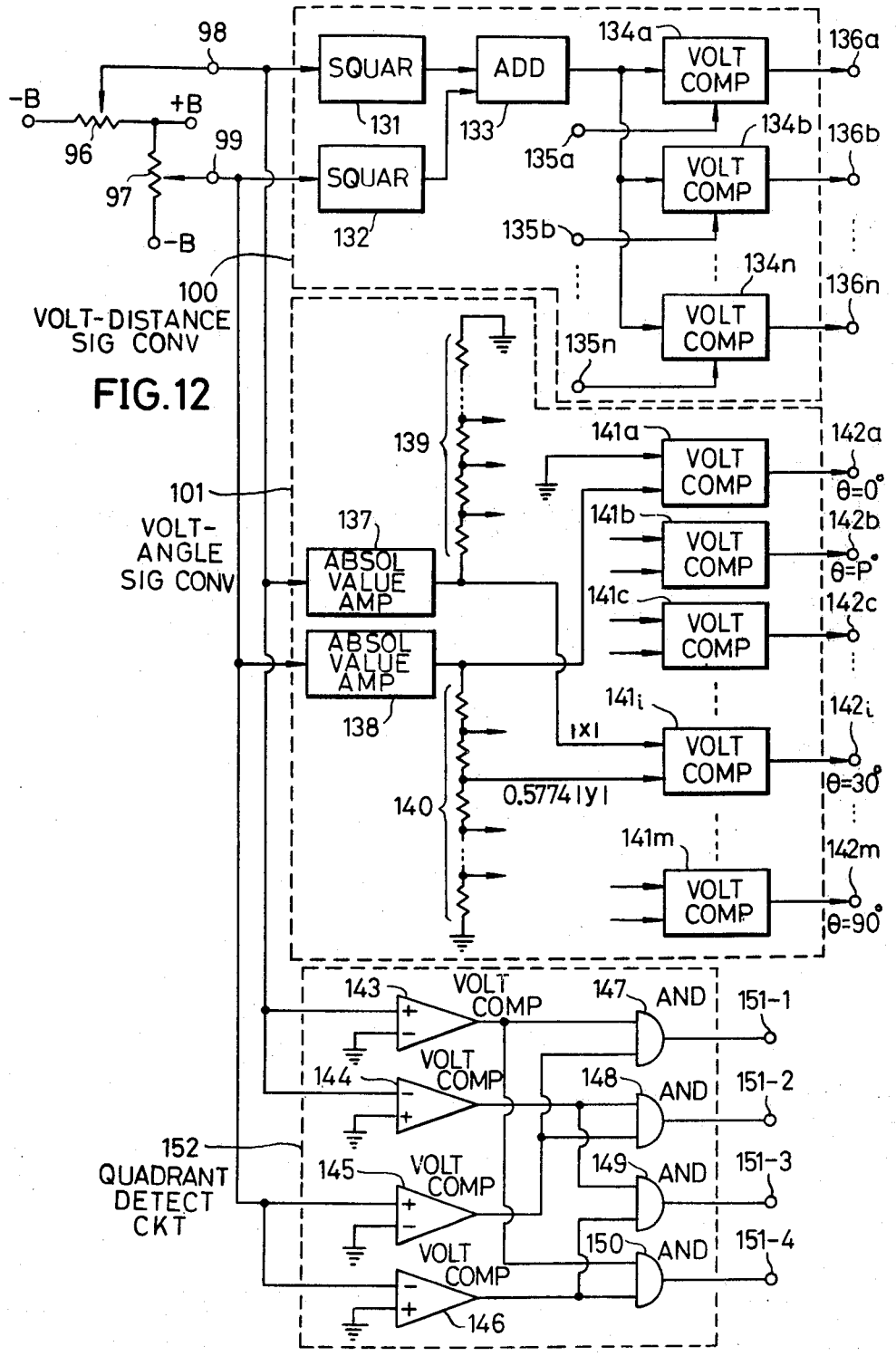
FIG. 12 is a block schematic diagram showing another embodiment of a sound image localization control signal producing circuit.

Another embodiment of the control signal conversion circuit 35 is illustrated in FIG. 12. In FIG. 12, those parts which are the same as corresponding parts in FIG. 9 are designated by like reference numerals or characters. Such parts will not be described in detail again.

The output DC voltages obtained at the output terminals 98 and 99 are supplied to squaring circuits 131 and 132, where they are converted into signals representing $x^2$ and $y^2$ and are then supplied to an adder 133. In the adder 133, these signals are added and become a signal representing $(x^2+y^2)$. This resulting output signal of the adder 133 is supplied as an analog signal representing the square $r^2$ of the above mentioned distance r respectively to n voltage comparators **134*a* through 134*n***. Here, n is any positive integer.

Voltages corresponding to the squares of the distances from the origin of the above mentioned coordinates, which have been measured beforehand, are being applied as reference voltages through terminals **135*a* through 135*n* to the voltage comparators 134*a* through 134*n*. Consequently, as a result of comparison of the levels of the above mentioned DC analog signal represented by $r^2$ and the above mentioned reference voltages respectively by the voltage comparators 134*a* through 134*n*, signals corresponding to distances are produced by the voltage comparators. As a consequence, output signals $r_0$ through $r_{n-1}$ respectively expressing distances are obtained through output terminals 136*a* through 136*n***.

On the other hand, the DC voltages obtained from the terminals 98 and 99 are supplied to absolute-value amplifiers 137 and 138 in the voltage-angle signal conversion circuit 101, where they are converted into signals representing the absolute values $|x|$ and $|y|$, and DC voltages which are always positive or zero are produced as output as a $|x|$ signal and a $|y|$ signal. These $|x|$ signal and $|y|$ signal are divided with specific ratios by resistors 139 and 140 and then supplied respectively to m voltage comparators **141*a* through 141*m***. Here, m is any positive integer.

A method of detecting the angle $\theta$ by using the $|x|$ and $|y|$ signals will now be described.

Figure 13:
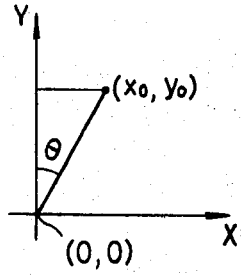
FIG. 13 is a diagramatic view for a description of angle detection.

It will be supposed that a point (xo, yo) as indicated in FIG. 13 is given. Here, only the case of the first quadrant will be considered. The following equation is obtained for the angle $\theta$ between the line (representation of the stick 91) joining the origin and the point (xo, yo) and the Y axis.

$$\tan\theta = x_0/y_0 \tag{7}$$

Accordingly, when $\theta=30°$, for example, tan $30°=0.5774$, whereby $x_0/y_0=0.5774$, and $x_0=0.5774$ $y_0$. Accordingly, by so adapting the voltage comparator **141*i*** (where i is a positive integer) that it operates when the state of $$|x| = |y| \times 0.5774$$

is attained, it can be judged that $\theta=30°$ by the sending out of the output signal of the voltage comparator **141*i***.

In the same manner, thereafter, by applying the relationship of the absolute values $|x|$ and $|y|$ corresponding to each angle to the respective one of the voltage comparators 141*a* through 141*m*, the angle $\theta$ can be determined from the output thereof. Signals of angles $\theta$ between 0° and 90° are led out respectively from output terminals 142*a* through 142*m*. In this manner the angles can be judged without using a divider.

Since the output signals of the absolute value amplifiers 137 and 138 always represent positions within the coordinates of the first quadrant, only angles within the range of 0° to 90° can be judged by the output signals of the voltage comparators 141*a* through 141*m*. Consequently, it is necessary to judge in which quadrant of the coordinates the point of (x, y) coresponding to the position of the stick 91 is and to convert from 0° to 360° with respect to the angle reference point.

Accordingly, a quadrant detection circuit 152 is provided. The output DC voltage of the terminal 98 is supplied to voltage comparators 143 and 144, and the output DC voltage of the terminal 99 is supplied to voltage comparators 145 and 146. When the output DC voltages of the terminals 98 and 99 are positive or zero, signals are produced as outputs from the voltage comparators 143 and 145. When these DC voltages are negative, signals are produced as outputs from the voltage comparators 144 and 146.

The output signal of the voltage comparator 143 is applied to two-input AND circuits 147 and 150, while the output signal of the voltage comparator 144 is applied to two-input AND circuits 148 and 149. The output signal of the voltage comparator 145 is applied to the AND circuits 147 and 148, and the output signal of the voltage comparator 146 is applied to the AND circuits 149 and 150.

Accordingly, in the case where the stick 91 is in the first quadrant of the coordinates, for example, $x \geqq 0$ and $y \geqq 0$. Therefore, a signal is produced as output only from the AND circuit 147. Similarly, output signals of the AND circuits 148, 149, and 150 are obtained respectively through output terminals 151-1 through 151-4 only when the stick 91 is in the second, third, and fourth quadrants of the coordinates.

By carrying out judgement of the various quadrants in this manner, angles from 0° to 360° can be detected.

In general, when the stick 91 is being moved by manual manipulation, it is seen to move in a meandering path when examined minutely because of oscillatory movement of the hand. For this reason, in the case where the rotational range of the stick 91 is so set as to obtain position-indicating signals with division into n equal parts with respect to each quadrant, there is a tendency of the stick 91 to pass through other quadrants, because of its meandering movement, as it passes through the origin. For example, when the stick 91 is intended to pass from the second quadrant through the origin and thus move into the fourth quadrant, it tends to enter also the first and third quadrants in regions thereof in the vicinity of the origin, whereby the position-indication information of the signal easily becomes unstable.

Figure 14:
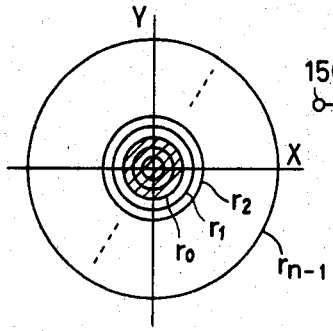
FIG. 14 is a diagramatic view for a description of divided sections for moving area of a sound image position control device.

Accordingly, in order to solve this problem, the distance is divided into equal parts (n+2) as indicated in FIG. 14, and three divisions, for example, of these equal divisions are allotted around the origin. As a result, at the time when the stick 91 is passed through the origin, the information of the origin is produced as output even when there is oscillation within a division of 3/(n+2) with the origin as a center as indicated by hatching.

This can be realized by selecting the reference voltage applied to the terminal 135*a* shown in FIG. 12 to cover the first three divisions of the (n+2) equal divisions and selecting the reference voltages applied to the terminals 135*b* through 135*n* at voltages corresponding to the fourth through the (n+2)th divisions of the (n+2) equal divisions.

Moreover, when the stick 91 is manually manipulated to move near the boundaries of each quadrant, for the purpose of changing distance, the stick 91 also moves meanderingly caused by tremble of the manipulating hand of the listener. As a consequence, the signal information of quadrant undergoes change from time to time between adjacent quadrants. This difficulty may be overcome by imparting hysterisis characteristics to the quadrant detecting operation of the quadrant detection circuit 152 indicated in FIG. 12.

Figure 15:
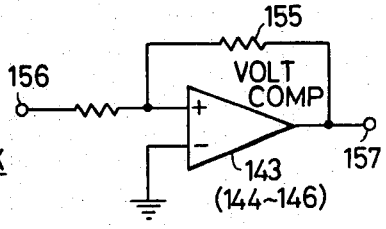
FIG. 15 is a circuit diagram showing an improved modification of a voltage comparator in a quardrant detection circuit.
Figure 16A:
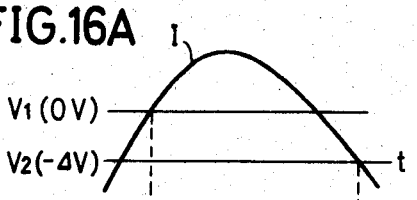
FIGS. 16A and 16B are graphs respectively indicating a relationship between the input and output voltages of a voltage comparator.
Figure 16B:
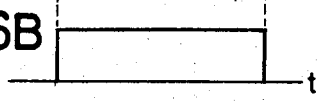

A voltage comparator 143 (144 through 146) in the quadrant detection circuit 152 is organized as indicated in FIG. 15, for example. The output of the voltage comparator 143 (144 through 146) is fed back, in portion, to a non-inverted input terminal thereof by way of a resistor 155. Accordingly, the voltage comparator 143 (144 through 146) is rendered "ON" when the DC voltage introduced through an input terminal 153 increases to exceed a predetermined voltage value V1(OV), and is rendered "OFF" when the DC voltage is decreased less than a predetermined voltage value V2(<V1), as indicated in FIG. 16A. In the case where the voltage applied to the input terminal 156 undergoes change as indicated by a curve I in FIG. 16A, the output as indicated in FIG. 16B is derived from an output terminal 157. Therefore, even though the input voltage is decreased less than a voltage V1, the signal is continuously derived from the output terminal 157, until the input voltage decreases less than a voltage V2.

Figure 17:
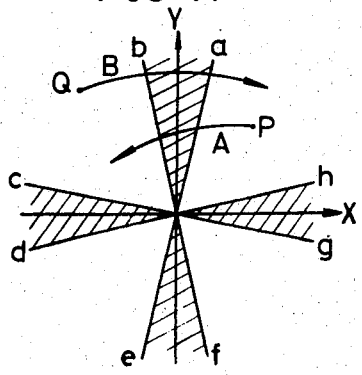
FIG. 17 is a diagramatic view for a description of hysteresis characteristic of output voltage with respect to quadrants in which a stick moves.

In the case where a mapping of a certain point of the stick onto the horizontal plane is positioned at a point P within a first quadrant and is moved in a direction indicated by an arrow A interrelatedly with motion of stick, as indicated in FIG. 17, for example, the output of the voltage comparators 143 through 146 becomes as follows.

Firstly, when the stick is positioned at a point P, which is within the first quadrant with being separated from X and Y axes, the signals are being derived from the voltage comparators 143 and 145, whereby a first quadrant detection pulse is being derived only from the terminal 151-1. Whereupon the stick passes the Y axis as the stick moves in the arrow direction A, the voltage comparator 144 is rendered "ON" and the voltage comparators 144 and 145 output signals. However, at this time, the voltage comparator 143 still continues to output the signal, due to the above described hysterisis effect. Then, when the stick reaches a line b within a second quadrant, the voltage comparator 143 is rendered "OFF" for the first time, and the voltage comparators 144 and 145 produce output signals. Accordingly, only from the terminals 151-2, is derived a second quadrant detection pulse.

Similarly, when a projection of the stick is at a position Q and is caused to move in the direction indicated by an arrow B, the pulses are led out from the terminals as follows. Specifically, when the projection is at a position between the Y axis and a line a, the voltage comparators 143, 144, and 145 assume "ON," whereby the first quadrant detection pulse and the second quadrant detection pulse are simultaneously led out from the terminals 151-1 and 151-2. When the projection passes the line a, the voltage comparator 144 is rendered "OFF," for the first time, due to hysteresis effect, whereby only the first quadrant detection pulse is derived. The result is the same also in the case where the mapping of the stick moves between the other adjacent quadrants.

Next to be described is an improved embodiment of a switching circuit for the use of each embodiment referred to above.

In the case where the level or frequency characteristics of the signal are subjected to switching in a digital manner and thereby caused to be changed abruptly, and then, the resulting signal is applied to a speaker thereby to be converted and emitted as sound, the abrupt change in signal is heard as a kind of noise for the listener. For eliminating this difficulty, the embodiment described hereinafter is so arranged that, when the level of signal is changed from one value to another value, the level firstly assumes an intermediate value between both level values, and then changed to the above described another value.

In the case where no control signals SA and SB are being applied, switching elements 165, 167, 168, and 170 respectively assume their "OFF" states. Accordingly, the signal introduced through the input terminal 161 is led out from the output terminal 162, with a level L maintained at a level at the time when it is introduced.

Next, when the control signal SA is introduced at a time instant t1, this control signal SA is applied, on one hand, to the switching element 165 thereby being rendered "ON," and on the other hand, after subjected to delay by a predetermined time in a delay circuit 166, to a switching element 167 thereby being rendered "ON." The assumption is now made that another control signal SB is not introduced during that time.

Accordingly, due to "ON" state of the switching element 165 at the time instant t1, the level of the output signal becomes L1, which is expressed as follows.

$$L_1 = \frac{R_{2a}}{R_1 + R_{2a}} L = \frac{2R_2}{R_1 + 2R_2} L < L \text{ wherein } R_{2a} = 2R_2.$$

Upon the elapse of a specific time $\tau 1$, after the time instant t1, that is, at the time instant t2(=t1+$\tau$1), the switching elements 165 and 167 respectively assume their ON states, whereby the output signal becomes a level which is equal to the above given level L2.

Next, assuming that the control signal SB is introduced at a time instant t3 to the circuit to which the control signal SA is being applied. The control signal SB causes a switching element 168 to assume its "ON" state. On the other hand, the control signal SB is delayed by a specific time $\tau 2$ in a delay circuit 169, and thereafter, is applied to a switching element 170 thereby assuming its "ON" state.

Accordingly, at a time instant t3, the switching elements 165, 167, and 168 respectively assume their "ON" states, whereby the level of the signal at the output terminal is attenuated to L3. The level L3 is expressed as follows.

$$L3=(R2a//R2b//R3a)L/(R1+(R2a//R2b//R3a))<L2$$

where $$R2a//R2b//R3a = 1/(\frac{1}{R2a} + \frac{1}{R2b} + \frac{1}{R3a}).$$

Finally, at the time instant $t4$ (=$t3$+$t2$), the switching elements 165, 167, 168, and 170 are respectively rendered "ON," whereby the level of the output signal is attenuated to a level equal to the above given level L4.

Figure 19:
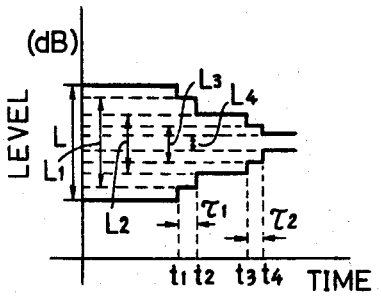
FIG. 19 is a graph indicating a change in level of output signal of a circuit shown in FIG. 18.

As is apparent from the description set forth, the level of signal led out from the output terminal 162 undergoes change as indicated in FIG. 19. Specifically, when changing over level from L to L2, and L2 to L4, the levels L and L2 are respectively changed over by way of intermediate level stages L1 and L3. Accordingly, the noise is favorably releaved in compared with the prior art.

Moreover, change of signal level from a certain level to a separate level is not limited to two stages as set forth hereinabove, but three or more stages may be employed. In this case, more reduction in noise can be attained.

Figure 18:
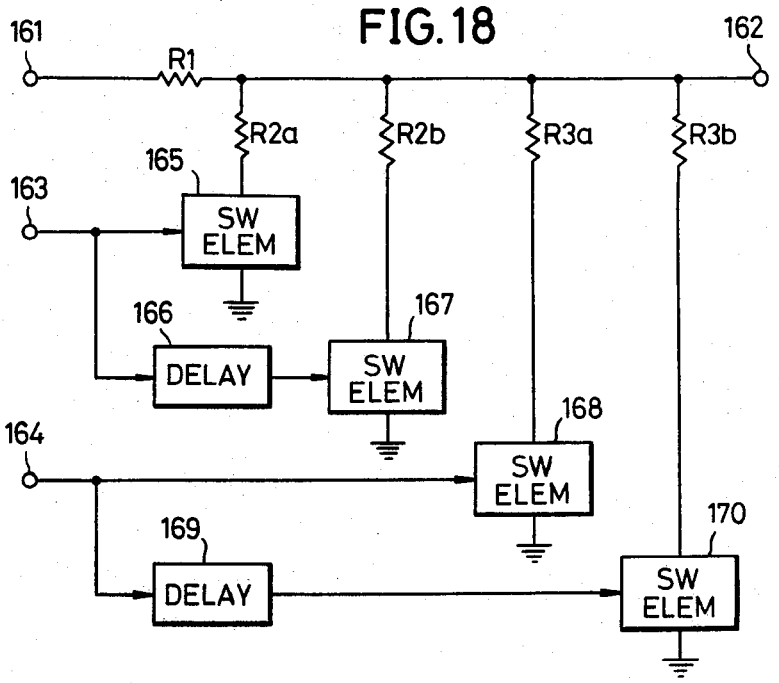
FIG. 18 is a circuit schematic diagram showing one embodiment of a switching circuit.
Figure 20:
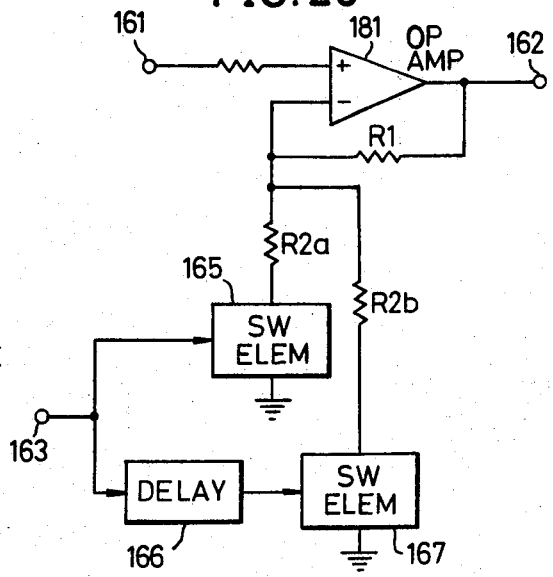
FIG. 20 is a circuit diagram of another embodiment of the switching circuit.

Another embodiment of the switching circuit is indicated in FIG. 20, in which, parts corresponding to those in FIG. 18 are designated by like reference numerals.

The signal of level of L introduced through the input terminal 161 is applied to a non-inverted input terminal of an operational amplifier 181, where it is amplified, and is then led out from the output terminals 162. In the case where no control signal SA is applied to the terminal 163, and the switching elements 165 and 167 thereby assume "OFF," the signal having a level approximate to L is derived from the output terminal 162.

Whereupon the control signal SA is introduced, the switching element 165 is rendered "ON," whereby the level of the output signal is increased to (1+(R1/R2*a*))L. Further, upon the elapse of the delay time $\tau 1$ determined by the delay circuit 166, the switching element 167 is also rendered "ON," whereby the level of the output signal is enhanced or increased up to (1+(R1/R2))L. In the above expression, the following relationship $R2a=R2b=2R2$ is held.

Accordingly, in the case of increasing the level of signal as described hereinbefore, generation of noise at the time when the level is changed over can be decreased or suppressed effectively.

Moreover, in the case where the signal obtained from the circuit of the present invention is not applied to the headphone but is applied to the loud speakers disposed at position aparted from the listener thereby to be emitted as sounds, it is preferable to cause a signal obtained by a circuit of the present invention to pass through a circuit disclosed in "signal processing circuits" in U.S. Pat. application No. 786.675, which has been proposed by the present applicant.

Further, this invention is not limited to these embodiments but various variations and modifications may be made without departing from the scope of the invention.

What is claimed is:

1. A binaural signal processing circuit comprising:

first means for imparting an input signal with a first transfer characteristic equal to the transfer characteristic hL (t; $\theta$, r) from a sound source to one of the ears of a listener who is near the sound source, where $\theta$ represents an angle between the front direction of the listener and the sound source, and r represents a distance between the sound source and the listener; said first transfer characteristic being variable and corresponding to first control signals applied to said first means;

second means for imparting the input signal with a second transfer characteristic equal to the transfer characteristic hR (t; $\theta$, r) from the sound source to the other ear of the listener, said second transfer characteristic being variable and corresponding to second control signals applied to said second means;

sound image position control device means for producing signals corresponding to coordinates of a position where a sound image is to be localized, wherein the listener lies at the origin of the coordinate system;

control signal conversion means for converting the output signals of said sound image position control device means into the first and second control signals; and means for deriving binaural signals from said first and second transfer characteristic imparting means.

2. A binaural signal processing circuit as claimed in claim 1 in which:

said first transfer characteristic imparting means comprises first attenuation means for attenuating the input signal in accordance with a third control signal applied thereto, and first filter means for filtering the output signal of said first attenuation means with a frequency characteristic which is varied in accordance with a fourth control signal applied thereto;

said second transfer characteristic imparting means comprises second attenuation means for attenuating the output signal of said first filter means in accordance with a fifth control signal applied thereto, second filter means for filtering the output signal of said second attenuation means with a frequency characteristic which is varied in accordance with a sixth control signal applied thereto, and delay means for delaying the output signal of said second filter means by a delay quantity which is variable in accordance with a seventh control signal applied thereto; and said control signal conversion means produces said third, fourth, fifth and seventh control signals from the output signals of said sound image position control device means.

3. A binaural signal processing circuit as claimed in claim 2 in which:

each of said first and second attenuation means comprises a plurality of attenuation circuits having respectively different attenuation quantities, and analog switch means for being connected to one attenuation circuit selected from the plurality of attenuation circuits;

each of said first and second filter means comprises a plurality of filter circuits having respectively different filtering characteristics, and second analog switch means for being connected to one filter circuit selected from the plurality of filter circuits;

said delay means comprises a plurality of delay circuits having respectively different delay quantities, and third analog switch means for being connected to one delay circuit selected from the plurality of delay circuits; and said control signal conversion means further comprises means responsive to the third control signal for switching over the analog switch means in said first attenuation means, means responsive to the fourth control signal for switching over the analog switch means in said first filter means, means responsive to the fifth control signal for switching over the analog switch means in said second attenuation means, means responsive to the sixth control signal for switching over the analog switch means in said second filter means, and means responsive to the seventh control signal for switching over the analog switch means in said delay means.

4. A binaural signal processing circuit as claimed in claim 1 in which:

said sound image position control device means comprises a manual manipulation member rotatable about a predetermined position to be inclined to any direction with respect to a reference plane which includes the predetermined position, and generating means for generating two signal voltages corresponding to the coordinates (x, y) of the manual manipulation member when the manual manipulation member is projected on a rectangular coordinate system (X Y) which lies on the reference plane and has the predetermined position as the origin; and said control signal conversion means comprises means for converting said two signal voltages into a signal having information related to the distance between the sound source and the listener, means for converting said two signal voltages into a signal having information related to the angle between the front direction of the listener and the sound source, and means for deriving the first and second control signals from the output signals of the respective converting means.

5. A binaural signal processing circuit as claimed in claim 4, in which said control signal conversion means further comprises means for detecting the quadrant in the rectangular coordinate system in which the coordinates (x, y) of the manual manipulation member lie, said driving means deriving the first and second control signals from the output signals of said detecting means and respective converting means.

6. A binaural signal processing circuit comprising:

first signal conversion means including first means for imparting an input signal with a first transfer characteristic hL (t; $\theta$, r)/hL (t; $\theta$, $r_o$) wherein hL (t; $\theta$, r) is a transfer characteristic from a sound source to one of the ears of a listener who is near the sound source, $\theta$ represents an angle between the front direction of the listener and the sound source, r represents a distance between the sound source and the listener, and $r_o$ represents a reference distance between the sound source and the listener, said first transfer characteristic being variable corresponding to first control signals applied to said first means, and second means for imparting the output signal of said first means with a second transfer characteristic $$\frac{hR(t;\theta,r)/hL(t;\theta,r)}{hR(r;\theta,r_0)/hL(t;\theta,r_0)}$$

wherein hR (t; $\theta$, r) is a transfer characteristic from the sound source to the other ear of the listener, said second transfer characteristic being variable corresponding to second control signals applied to said second means;

second signal conversion means for imparting the output signal of said first means with the transfer characteristic hL (t; $\theta$, $r_o$) and imparting the output signal of said second means with the transfer characteristic hR (t; $\theta$, $r_o$), said second signal conversion means comprising a plurality of signal conversion circuits having respectively different transfer characteristics which are different with respect to the angle $\theta$ in hL (t; $\theta$, $r_o$) and in hR (t; $\theta$, $r_o$), and switching means for supplying the output signals of the first and second means in said first signal conversion means to one signal conversion circuit selected from the plurality of signal conversion circuits corresponding to a third control signal applied thereto;

sound image position control device means for producing signals corresponding to coordinates of a position where a sound image is to be localized, wherein the listener lies at the origin of the coordinate system; and control signal conversion means for converting the output signals of said sound image position control device means into the first, second and third control signals.

* * * * *